US012287143B2

(12) United States Patent
Zhou et al.

(10) Patent No.: US 12,287,143 B2
(45) Date of Patent: Apr. 29, 2025

(54) CONTROL METHOD OF REFRIGERATING AND FREEZING DEVICE AND REFRIGERATING AND FREEZING DEVICE

(71) Applicants: QINGDAO HAIER REFRIGERATOR CO., LTD., Shandong (CN); HAIER SMART HOME CO., LTD., Shandong (CN)

(72) Inventors: Heng Zhou, Qingdao (CN); Yi Huang, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 218 days.

(21) Appl. No.: 17/771,282

(22) PCT Filed: Sep. 8, 2020

(86) PCT No.: PCT/CN2020/114071
§ 371 (c)(1),
(2) Date: Apr. 22, 2022

(87) PCT Pub. No.: WO2021/077924
PCT Pub. Date: Apr. 29, 2021

(65) Prior Publication Data

US 2022/0373251 A1 Nov. 24, 2022

(30) Foreign Application Priority Data

Oct. 24, 2019 (CN) ..... 201911019647.8

(51) Int. Cl.
*F25D 11/02* (2006.01)
*F25D 29/00* (2006.01)

(52) U.S. Cl.
CPC ..... *F25D 29/003* (2013.01); *F25D 11/02* (2013.01)

(58) Field of Classification Search
CPC .... F25D 11/02; F25D 2600/06; F25D 29/003; F25D 2400/28; F25D 2400/30;
(Continued)

(56) References Cited

U.S. PATENT DOCUMENTS 8,001,795 B2 * 8/2011 Pfister ..... F25D 31/007 62/62
9,373,164 B2 6/2016 Lee et al.
(Continued)

FOREIGN PATENT DOCUMENTS

CN 103940190 A 7/2014
CN 103983082 A 8/2014
(Continued)

OTHER PUBLICATIONS

International Search Report for PCT/CN2020/114071 (ISA/CN) mailed Nov. 24, 2020 with English translation (6 pages).
(Continued)

*Primary Examiner* — Filip Zec
(74) *Attorney, Agent, or Firm* — ALSTON & BIRD LLP

(57) ABSTRACT

A control method of a refrigerating and freezing device and a refrigerating and freezing device are provided. The refrigerating and freezing device includes a cabinet defining a storage compartment. The control method includes a refrigerating operation step, a foodstuff determining step, and a cooling operation step. The refrigerating operation step is to control a temperature of the storage compartment to be within a first preset temperature range. The foodstuff determining step is to determine whether a new foodstuff is put into the storage compartment. The cooling operation step is to, when a new foodstuff is put into the storage compart-
(Continued)

ment, cool the storage compartment. Since the temperature of the new foodstuff is greater than that of the original foodstuffs in the refrigerating and freezing device, cooling the storage compartment changes a storage temperature suitable for the foodstuffs originally stored in the storage compartment into a storage temperature suitable for the foodstuffs originally stored in the storage compartment into a storage temperature suitable for the new foodstuff, and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device on the foodstuff is enhanced.

6 Claims, 6 Drawing Sheets

(58) Field of Classification Search
CPC .. F25D 2500/06; F25D 2700/02; F25D 29/00; F25D 29/005; F25D 2700/06
See application file for complete search history.

(56) References Cited

U.S. PATENT DOCUMENTS

| | | | | |
|---|---|---|---|---|
| 9,890,984 | B2 * | 2/2018 | Kim | F25D 17/062 |
| 10,935,299 | B2 * | 3/2021 | Davis | F25D 3/04 |
| 11,965,771 | B2 * | 4/2024 | Barreto | G06Q 10/087 |
| 12,073,616 | B2 * | 8/2024 | Dulski | H04L 12/2829 |
| 2003/0164754 | A1 * | 9/2003 | Roseen | G06Q 10/087 340/585 |
| 2007/0227161 | A1 | 10/2007 | Boer et al. | |
| 2011/0291827 | A1 * | 12/2011 | Baldocchi | G08B 21/0476 340/539.11 |
| 2018/0087824 | A1 * | 3/2018 | Han | F25D 23/069 |
| 2018/0120015 | A1 * | 5/2018 | Darka | F25D 29/005 |
| 2018/0192791 | A1 * | 7/2018 | Miller | F25D 23/02 |
| 2018/0299182 | A1 * | 10/2018 | Besore | F25D 17/065 |
| 2019/0195550 | A1 * | 6/2019 | Sakae | F25D 17/062 |
| 2019/0264975 | A1 | 8/2019 | Kim et al. | |
| 2020/0363119 | A1 * | 11/2020 | Shinozaki | F25D 29/008 |
| 2021/0156610 | A1 * | 5/2021 | Gong | A23L 3/365 |

FOREIGN PATENT DOCUMENTS

| | | | |
|---|---|---|---|
| CN | 104061752 | A | 9/2014 |
| CN | 105758109 | A | 7/2016 |
| CN | 106813454 | A | 6/2017 |
| CN | 107144086 | A | 9/2017 |
| CN | 206583216 | U | 10/2017 |
| CN | 108168189 | A | 6/2018 |
| CN | 109028745 | A | 12/2018 |
| CN | 109297252 | A | 2/2019 |
| CN | 110332758 | A | 10/2019 |
| CN | 110864487 | A | 3/2020 |
| JP | H11351722 | A | 12/1999 |
| KR | 101112202 | B1 | 12/2011 |

OTHER PUBLICATIONS

Written Opinion for PCT/CN2020/114071 (ISA/CN) mailed Nov. 24, 2020 (4 pages).
Extended European Search Report for EP Patent Application No. 20879293.7 dated Sep. 16, 2022 (7 pages).
1st Office Action for EP Patent Application No. 20868293.7 dated Oct. 21, 2022 (5 pages).
China Search Report for China Patent Application No. 2019110196478 dated Dec. 16, 2020 (3 pages).
1st Office Action for China Patent Application No. 2019110196478 dated Dec. 23, 2020 (4 pages).
2nd Office Action for China Patent Application No. 2019110196478 dated Jul. 12, 2021 (4 pages).
Decision of Rejection for China Patent Application No. 2019110196478 dated Nov. 3, 2021 (4 pages).
2nd Office Action issued for European Patent Application No. 20879293.7 dated Jun. 13, 2024 (7 pages).

* cited by examiner

CONTROL METHOD OF REFRIGERATING AND FREEZING DEVICE AND REFRIGERATING AND FREEZING DEVICE

CROSS-REFERENCE TO RELATED APPLICATIONS

The present application is a national phase entry of International Application No. PCT/CN2020/114071, filed Sep. 8, 2020, which claims priority to Chinese Patent Application No. 201911019647.8, filed Oct. 24, 2019, which are incorporated herein by reference in their entirety.

FIELD OF THE INVENTION

The present invention relates to the technical field of refrigeration equipment, and in particular to a control method of a refrigerating and freezing device and a refrigerating and freezing device.

BACKGROUND OF THE INVENTION

With the development of society and economy and the improvement of people's living standards, refrigerating and freezing devices have also become indispensable household appliances in people's daily lives.

At present, the temperature of a storage compartment of the refrigerating and freezing device will not change according to whether new foodstuffs are put into the storage compartment. In the existing refrigerating and freezing device, when new foodstuffs are put into the storage compartment, the temperature of the storage compartment is still kept within a temperature range before the new foodstuffs are put in. This kind of refrigerating and freezing device is not conducive to the preservation of the newly put foodstuffs.

BRIEF DESCRIPTION OF THE INVENTION

In view of the above problem, the present invention provides a control method of a refrigerating and freezing device and a refrigerating and freezing device to solve the above problem or at least partially solve the above problem.

One purpose of the present invention is to enhance the preservation effect of a refrigerating and freezing device on foodstuffs.

A further purpose of the present invention is to make the refrigerating and freezing device more intelligent.

The present invention first provides a control method of a refrigerating and freezing device. The refrigerating and freezing device includes a cabinet defining a storage compartment. The control method includes: a refrigerating operation step: controlling a temperature of the storage compartment to be within a first preset temperature range; a foodstuff determining step: determining whether a new foodstuff is put into the storage compartment; and a cooling operation step: when a new foodstuff is put into the storage compartment, cooling the storage compartment.

Optionally, after the cooling operation step, the control method further includes: a temperature determining step: determining whether the temperature of the storage compartment is less than or equal to a preset copious cooling temperature value, the preset copious cooling temperature value being less than the lowest temperature of the first preset temperature range; and a copious cooling operation step: when the temperature of the storage compartment is less than or equal to the preset copious cooling temperature value, controlling the temperature of the storage compartment to be continuously within a second preset temperature range for a preset time threshold, the highest temperature value of the second preset temperature range being the preset copious cooling temperature value.

Optionally, the refrigerating and freezing device further includes a prompt module, and the copious cooling operation step further includes: controlling the prompt module to send a prompt signal that the refrigerating and freezing device proceeds to the copious cooling operation step.

Optionally, the control method further includes: returning to the refrigerating operation step after the copious cooling operation step; and the refrigerating operation step further includes: controlling the prompt module to send a prompt signal that the refrigerating and freezing device proceeds to the refrigerating operation step.

Optionally, the second preset temperature range is −20° C. or below, and the preset time threshold is 23 h to 25 h.

Optionally, the first preset temperature range is −17° C. to −19° C.

Optionally, the foodstuff determining step includes: a first determining step of determining whether the storage compartment is opened and whether the temperature of the opened storage compartment rises to a preset temperature threshold; and when the storage compartment is opened and the temperature of the opened storage compartment rises to the preset temperature threshold, determining that a new foodstuff is put into the storage compartment.

Optionally, the refrigerating and freezing device includes an input module; the input module is used for acquiring information input by a user indicating that a new foodstuff is put into the storage compartment; and the foodstuff determining step includes: a second determining step of determining whether the input module acquires the information input by the user indicating that a new foodstuff is put into the storage compartment; and when the input module acquires the information input by the user indicating that a new foodstuff is put into the storage compartment, determining that a new foodstuff is put into the storage compartment.

Optionally, the refrigerating and freezing device includes a weighing module used for acquiring a weight of foodstuffs stored in the storage compartment; and the foodstuff determining step includes: a third determining step of determining whether the weight of the foodstuffs stored in the storage compartment is increased; and when the weight of the foodstuffs stored in the storage compartment is increased, determining that a new foodstuff is put into the storage compartment.

According to another aspect of the present invention, a refrigerating and freezing device is further provided, including: a cabinet defining a storage compartment inside; a controller including a memory and a processor, the memory storing a control program, and the control program, when executed by the processor, being used for implementing any above control method of a refrigerating and freezing device.

The present invention provides a control method of a refrigerating and freezing device and a refrigerating and freezing device. The refrigerating and freezing device includes a cabinet defining a storage compartment. The control method includes a refrigerating operation step, a foodstuff determining step, and a cooling operation step. The refrigerating operation step is to control a temperature of the storage compartment to be within a first preset temperature range. The foodstuff determining step is to determine whether a new foodstuff is put into the storage compartment. The cooling operation step is to, when a new foodstuff is put into the storage compartment, cool the storage compartment. Since the temperature of the new foodstuff is greater than that of the original foodstuffs in the refrigerating and freezing device, cooling the storage compartment can change a storage temperature suitable for the foodstuffs originally stored in the storage compartment into a storage temperature suitable for the new foodstuff and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device on the foodstuff is enhanced.

Further, the second preset temperature range is −20° C. or below; the preset copious cooling temperature value is −20° C.; and the preset time threshold is 23 h to 25 h. By setting the second preset temperature range, the preset copious cooling temperature value, and the preset time threshold, parasites in the foodstuffs can be killed, so as to further enhance the preservation effect of the refrigerating and freezing device on the foodstuff.

Still further, the refrigerating and freezing device further includes a prompt module, and the copious cooling operation step further includes: controlling the prompt module to send a prompt signal that the refrigerating and freezing device proceeds to the copious cooling operation step. The refrigerating operation step further includes: controlling the prompt module to send a prompt signal that the refrigerating and freezing device proceeds to the refrigerating operation step. This setting mode is convenient for the user to master the operation status of the refrigerating and freezing device at any time, so that the refrigerating and freezing device is more intelligent.

The above and other objectives, advantages, and characteristics of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION

Figure 1:
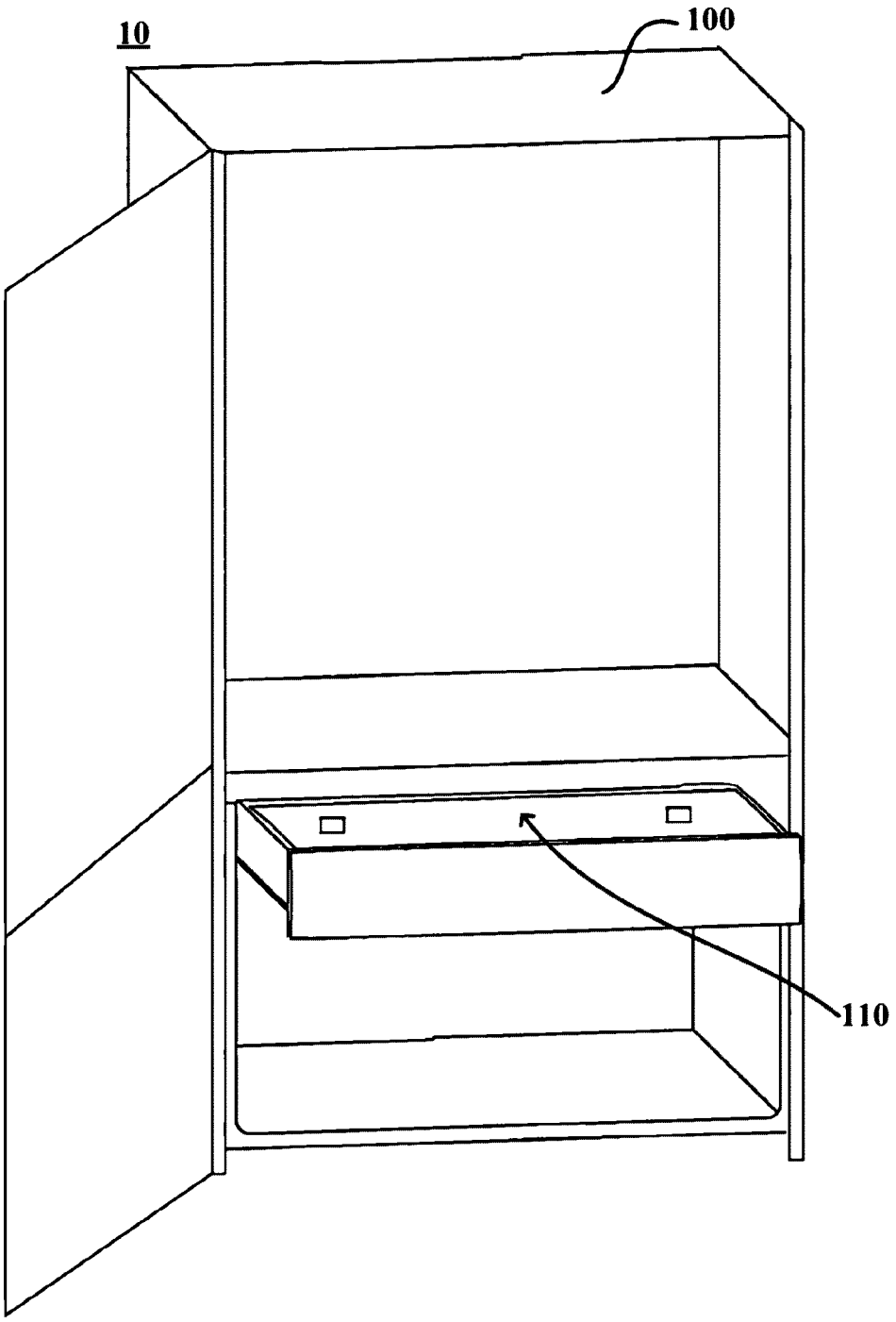
FIG. 1 is a schematic structural diagram of a refrigerating and freezing device according to one embodiment of the present invention.
Figure 2:
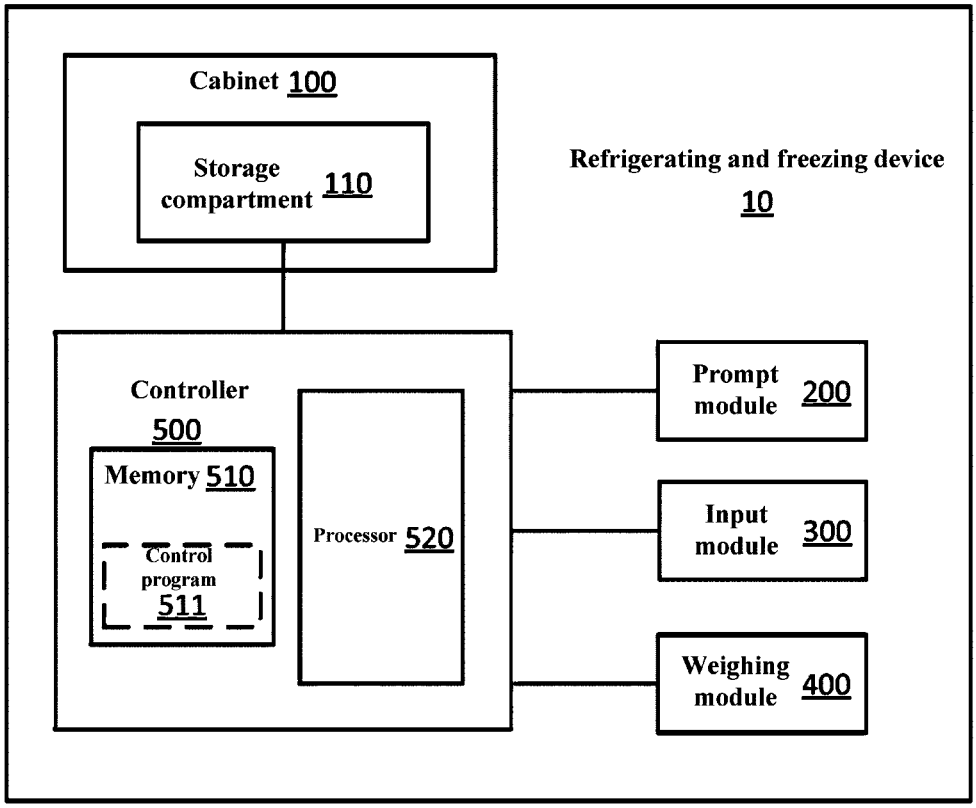
FIG. 2 is a schematic block diagram of a refrigerating and freezing device according to one embodiment of the present invention.

FIG. 1 is a schematic structural diagram of a refrigerating and freezing device 10 according to one embodiment of the present invention, and FIG. 2 is a schematic block diagram of a refrigerating and freezing device 10 according to one embodiment of the present invention.

A refrigerating and freezing device 10 includes a cabinet 100 and a controller 500. In some embodiments, the refrigerating and freezing device 10 may be a refrigerator. In some other embodiments, the refrigerating and freezing device 10 may also be a freezer or the like.

A storage compartment 110 is defined in the cabinet 100. In some embodiments, the storage compartment 110 may be a storage area defined by a drawer subassembly. In some other embodiments, the storage compartment 110 may also be an independent storage area divided by other separators such as a separation plate in a storage space.

The refrigerating and freezing device 10 may also have a refrigerating system, and the refrigerating system is used for providing cooling capacity for the storage compartment 110. The refrigerating system may include a compressor or a semiconductor subassembly. Since the refrigerating mode of the compressor and the refrigerating mode of a semiconductor are familiar to those skilled in the art, descriptions are omitted here.

The refrigerating and freezing device 10 may further include a prompt module 200, an input module 300, and a weighing module 400. The prompt module 200 may send a prompt signal. The input module 300 is used for acquiring information input by a user indicating that a new foodstuff is put into the storage compartment 110. The weighing module 400 is used for acquiring a weight of foodstuffs stored in the storage compartment 110.

The controller 500 includes a memory 510 and a processor 520. The memory 510 stores a control program 511. The control program 511, when executed by the processor 520, is used for implementing a control method of the refrigerating and freezing device 10. The controller 500 may control the refrigerating system to control a temperature of the storage compartment 110. The controller 500 may control the prompt module 200 to send a signal, and may also control the temperature of the storage compartment 110 according to the information input by the user through the input module 300 or the weight information of the foodstuffs acquired by the weighing module 400.

Figure 3:
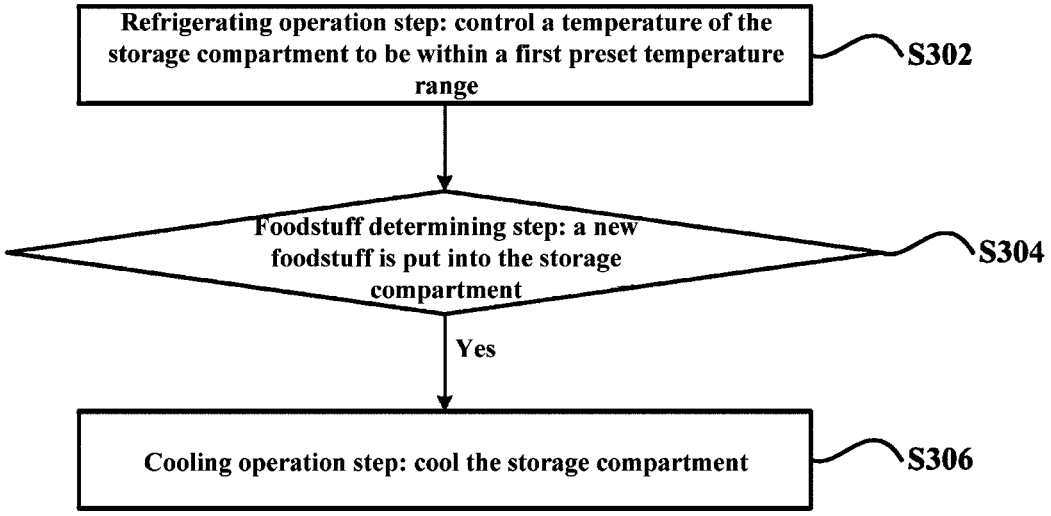
FIG. 3 is a schematic diagram of a control method of a refrigerating and freezing device according to one embodiment of the present invention.

This embodiment further provides a control method of the refrigerating and freezing device 10. The control method may be implemented by the controller 500 in the refrigerating and freezing device 10 of the above embodiment. FIG. 3 is a schematic diagram of a control method of a refrigerating and freezing device 10 according to one embodiment of the present invention. The control method of the refrigerating and freezing device 10 according to one embodiment of the present invention may generally include:

S302, a refrigerating operation step: a temperature of the storage compartment 110 is controlled to be within a first preset temperature range. The first preset temperature range is −17° C. to −19° C. Causing the temperature of the storage compartment 110 to be within the first preset temperature range can not only ensure a preservation effect on foodstuffs, but also avoid the phenomenon of waste of energy.

In some embodiments, in the refrigerating operation step, the prompt module 200 may be further controlled to send a prompt signal that the refrigerating and freezing device 10 proceeds to the refrigerating operation step. The prompt signal may be a sound signal, a light signal, or a smell signal or the like. This setting mode is convenient for the user to master the operation status of the refrigerating and freezing device 10 at any time, so that the refrigerating and freezing device 10 is more intelligent, and the user experience is enhanced.

S304, a foodstuff determining step: whether a new foodstuff is put into the storage compartment 110 is determined. If yes, step S306 is executed; and if not, returning to step S302.

In some embodiments, it can be determined that whether the storage compartment 110 is opened and whether the temperature of the opened storage compartment 110 rises to a preset temperature threshold; and when the storage compartment 110 is opened and the temperature of the opened storage compartment 110 rises to the preset temperature threshold, it is determined that a new foodstuff is put into the storage compartment 110. The preset temperature threshold may be 1° C. to 5° C., such as PC, 3° C., 5° C., or the like. The specific numerical value may be measured according to an experiment. When the storage compartment 110 is opened, a new foodstuff is possibly put into the storage compartment 110, and putting the new foodstuff into the storage compartment 110 will cause the temperature of the storage compartment 110 to rise. Therefore, this method for determining whether a new foodstuff is put into the storage compartment 110 achieves an accurate determining result, and additional smart equipment for determining whether a new foodstuff is put into the storage compartment 110 is not required, so that the refrigerating and freezing device 10 is low in cost.

In some other embodiments, the refrigerating and freezing device 10 may include an input module 300. The input module 300 is used for acquiring information input by a user indicating that a new foodstuff is put into the storage compartment 110. Whether the input module 300 acquires the information input by a user indicating that a new foodstuff is put into the storage compartment 110 can be determined. When the input module 300 acquires the information input by a user indicating that a new foodstuff is put into the storage compartment 110, it is determined that a new foodstuff is put into the storage compartment 110. For example, a button is arranged on an outer surface of the cabinet 100 of the refrigerating and freezing device 10. The user operates the button to input the information indicating that a new foodstuff is put into the storage compartment 110. This method for determining whether a new foodstuff is put into the storage compartment 110 is more accurate and effective.

In other embodiments, the refrigerating and freezing device 10 may include a weighing module 400 used for acquiring a weight of foodstuffs stored in the storage compartment 110. Whether the weight of the foodstuffs stored in the storage compartment 110 is increased can also be determined. When the weight of the foodstuffs stored in the storage compartment 110 is increased, it is determined that a new foodstuff is put into the storage compartment 110. This scheme for determining, by means of the weighing module 400 for acquiring the weight of the foodstuffs stored in the storage compartment 110, whether a new foodstuff is put into the storage compartment 110 does not need to be manually operated, so that the refrigerating and freezing device 10 is more intelligent.

S306, a cooling operation step: the storage compartment 110 is cooled. Since the temperature of the new foodstuff is greater than that of the original foodstuffs in the refrigerating and freezing device 10, cooling the storage compartment 110 changes a storage temperature suitable for the foodstuffs originally stored in the storage compartment 110 into a storage temperature suitable for the new foodstuff, and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device 10 on the foodstuff is enhanced.

After the cooling operation step, the control method further includes a temperature determining step and a copious cooling operation step.

The temperature determining step: whether the temperature of the storage compartment 110 is less than or equal to a preset copious cooling temperature value is determined, the preset copious cooling temperature value being less than the lowest temperature of the first preset temperature range. The copious cooling operation step: when the temperature of the storage compartment 110 is less than or equal to the preset copious cooling temperature value, the temperature of the storage compartment 110 is controlled to be continuously within a second preset temperature range for a preset time threshold, the highest temperature value of the second preset temperature range being the preset copious cooling temperature value. That is, the new foodstuff put into the storage compartment 110 may be preserved for certain time at a low temperature. This control method makes the new foodstuff faster enter a status suitable for preservation.

In some embodiments, the second preset temperature range may be −20° C. or below. That is, the preset copious cooling temperature value is −20° C. The preset time threshold may be 23 h to 25 h. By setting the second preset temperature range, the preset copious cooling temperature value, and the preset time threshold, parasites in the foodstuffs can be killed, so as to further enhance the preservation effect of the refrigerating and freezing device 10 on the foodstuff.

The copious cooling operation step further includes: the prompt module 200 is controlled to send a prompt signal that the refrigerating and freezing device 10 proceeds to the copious cooling operation step. This setting mode is convenient for the user to master the operation status of the refrigerating and freezing device at any time and reminds the user trying not to open the storage compartment 110 within this period, so that the refrigerating and freezing device 10 is more intelligent.

Figure 4:
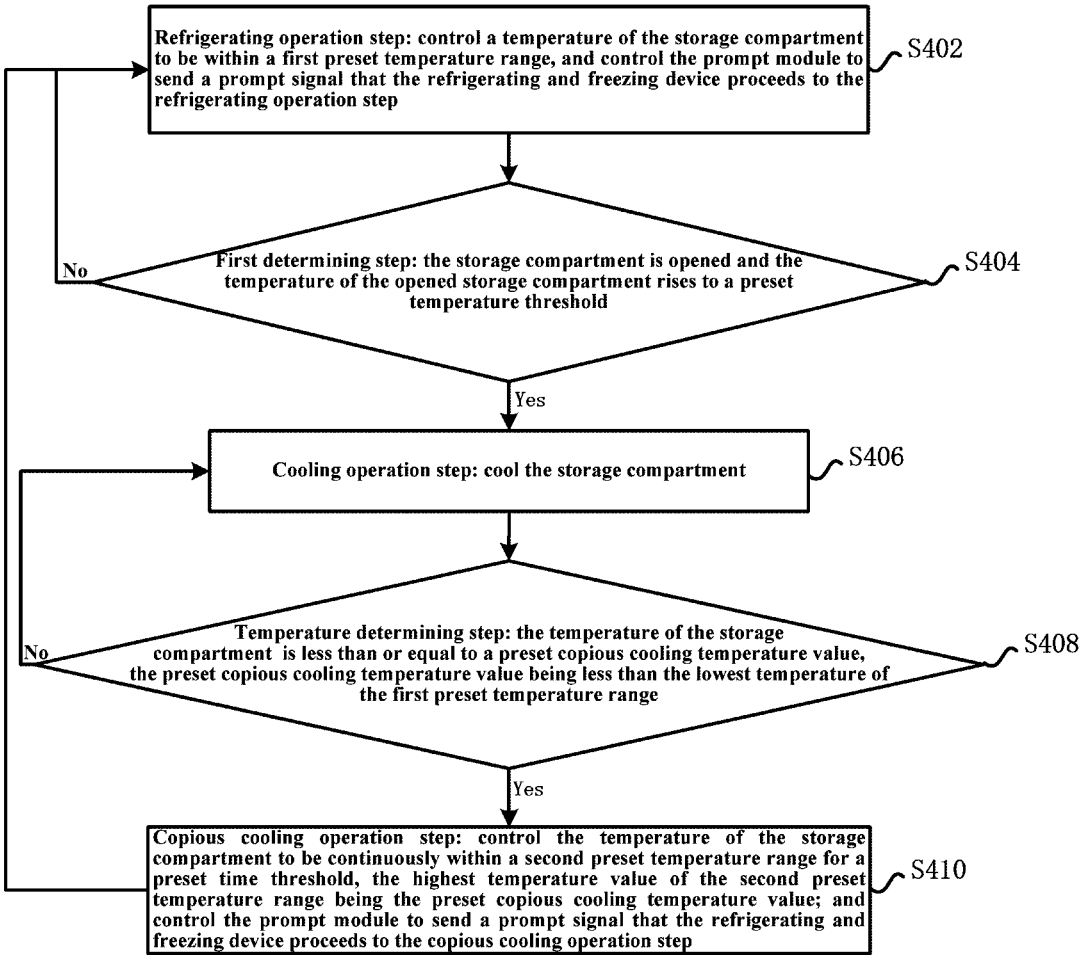
FIG. 4 is an execution flowchart of a control method of a refrigerating and freezing device according to one embodiment of the present invention.

FIG. 4 is an execution flowchart of a control method of a refrigerating and freezing device 10 according to one embodiment of the present invention. As shown in FIG. 4, an execution flow of the control method of the refrigerating and freezing device 10 according to the embodiment of the present invention may include:

S402, the refrigerating operation step: the temperature of the storage compartment 110 is controlled to be within the first preset temperature range, and the prompt module 200 is controlled to send the prompt signal that the refrigerating and freezing device 10 proceeds to the refrigerating operation step. The first preset temperature range is −17° C. to −19° C. Causing the temperature of the storage compartment 110 to be within the first preset temperature range can not only ensure a preservation effect on foodstuffs, but also avoid the phenomenon of waste of energy.

S404, a first determining step: whether the storage compartment 110 is opened and whether the temperature of the opened storage compartment 110 rises to the preset temperature threshold are determined. The preset temperature threshold may be 1° C. to 5° C., such as PC, 3° C., 5° C., or the like. The specific numerical value may be measured according to an experiment. When the storage compartment 110 is opened, a new foodstuff is possibly put into the storage compartment 110, and putting the new foodstuff into the storage compartment 110 will cause the temperature of the storage compartment 110 to rise. Therefore, this method for determining whether a new foodstuff is put into the storage compartment 110 achieves an accurate determining result, and additional smart equipment for determining whether a new foodstuff is put into the storage compartment 110 is not required, so that the refrigerating and freezing device 10 is low in cost. If not, step S402 is executed; and if yes, step S406 is executed.

S406, the cooling operation step: the storage compartment 110 is cooled. Since the temperature of the new foodstuff is greater than that of the original foodstuffs in the refrigerating and freezing device 10, cooling the storage compartment 110 changes a storage temperature suitable for the foodstuffs originally stored in the storage compartment 110 into a storage temperature suitable for the new foodstuff, and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device 10 on the foodstuff is enhanced.

S408, the temperature determining step: whether the temperature of the storage compartment 110 is less than or equal to the preset copious cooling temperature value is determined, the preset copious cooling temperature value being less than the lowest temperature of the first preset temperature range. If not, step S406 is executed; and if yes, step S410 is executed.

S410, the copious cooling operation step: the temperature of the storage compartment 110 is controlled to be continuously within the second preset temperature range for the preset time threshold, the highest temperature value of the second preset temperature range being the preset copious cooling temperature value; and the prompt module 200 is controlled to send the prompt signal that the refrigerating and freezing device proceeds to the copious cooling operation step. This control method causes the new foodstuff to enter a status suitable for preservation. The refrigerating and freezing device 10 may have a timing unit. Timing starts when the copious cooling operation step is started, and retiming starts when the temperature of the storage compartment 110 is not within the second preset temperature range. The copious cooling operation step ends till the time counted by the timing unit reaches the time threshold.

In some embodiments, the second preset temperature range may be −20° C. or below. That is, the preset copious cooling temperature value is −20° C. The preset time threshold is 23 h to 25 h. By setting the second preset temperature range, the preset copious cooling temperature value, and the preset time threshold, parasites in the foodstuffs can be killed, so as to further enhance the preservation effect of the refrigerating and freezing device 10 on the foodstuff.

In some embodiments, after the copious cooling operation step, returning to the refrigerating operation step, so as to save energy. In the refrigerating operation step, the prompt module 200 may be controlled to send a prompt signal that the refrigerating and freezing device 10 proceeds to the refrigerating operation step. The user is promoted that parasites in the foodstuffs in the storage compartment 110 have been killed and the foodstuffs can be safe to eat. Furthermore, since a frequency of a compressor or the like will change due to returning from the copious cooling operation step to the refrigerating operation step, the operation sound of the refrigerating and freezing device 10 will change. By the prompt signal sent by the prompt module 200, the user knows the operation status of the refrigerating and freezing device 10 and will not doubt the change in the operation sound of the refrigerating and freezing device 10. This improves the intelligence of the refrigerating and freezing device 10.

Figure 5:
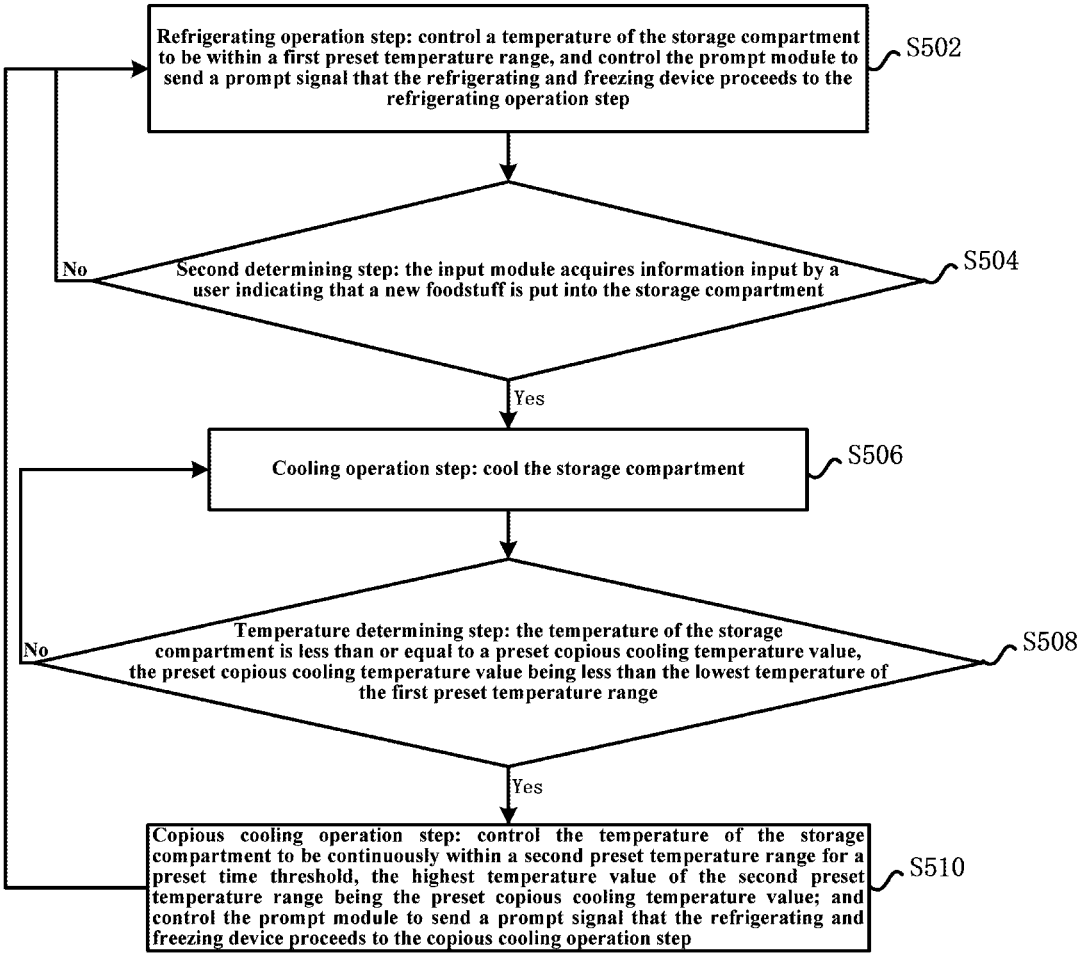
FIG. 5 is an execution flowchart of a control method of a refrigerating and freezing device according to another embodiment of the present invention.

FIG. 5 is an execution flowchart of a control method of a refrigerating and freezing device 10 according to another embodiment of the present invention. As shown in FIG. 5, an execution flow of the control method of the refrigerating and freezing device 10 according to the embodiment of the present invention may include:

S502, the refrigerating operation step: the temperature of the storage compartment 110 is controlled to be within the first preset temperature range, and the prompt module 200 is controlled to send the prompt signal that the refrigerating and freezing device 10 proceeds to the refrigerating operation step. The first preset temperature range is −17° C. to −19° C. Causing the temperature of the storage compartment 110 to be within the first preset temperature range can not only ensure a preservation effect on foodstuffs, but also avoid the phenomenon of waste of energy.

S504, a second determining step: whether the input module 300 acquires information input by the user indicating that a new foodstuff is put into the storage compartment 110 is determined. When the input module 300 acquires the information input by the user indicating that a new foodstuff is put into the storage compartment 110, it is determined that a new foodstuff is put into the storage compartment 110. For example, a button is arranged on an outer surface of the cabinet 100 of the refrigerating and freezing device 10. The user operates the button to input the information indicating that a new foodstuff is put into the storage compartment 110. This method for determining whether a new foodstuff is put into the storage compartment 110 is more accurate and effective. If not, step S502 is executed; and if yes, step S506 is executed.

S506, the cooling operation step: the storage compartment 110 is cooled. Since the temperature of the new foodstuff is greater than that of the original foodstuffs in the refrigerating and freezing device 10, cooling the storage compartment 110 changes a storage temperature suitable for the foodstuffs originally stored in the storage compartment 110 into a storage temperature suitable for the new foodstuff, and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device 10 on the foodstuff is enhanced.

S508, the temperature determining step: whether the temperature of the storage compartment 110 is less than or equal to the preset copious cooling temperature value is determined, the preset copious cooling temperature value being less than the lowest temperature of the first preset temperature range. If not, step S506 is executed; and if yes, step S510 is executed.

S510, the copious cooling operation step: the temperature of the storage compartment 110 is controlled to be continuously within the second preset temperature range for the preset time threshold, the highest temperature value of the second preset temperature range being the preset copious cooling temperature value; and the prompt module 200 is controlled to send the prompt signal that the refrigerating and freezing device 10 proceeds to the copious cooling operation step. This control method causes the new foodstuff to enter a status suitable for preservation. The refrigerating and freezing device 10 may have a timing unit. Timing starts when the copious cooling operation step is started, and retiming starts when the temperature of the storage compartment 110 is not within the second preset temperature range. The copious cooling operation step ends till the time counted by the timing unit reaches the time threshold.

In some embodiments, the second preset temperature range may be −20° C. or below. That is, the preset copious cooling temperature value is −20° C. The preset time threshold is 23 h to 25 h. By setting the second preset temperature range, the preset copious cooling temperature value, and the preset time threshold, parasites in the foodstuffs can be killed, so as to further enhance the preservation effect of the refrigerating and freezing device 10 on the foodstuff.

In some embodiments, after the copious cooling operation step, returning to the refrigerating operation step, so as to save energy. In the refrigerating operation step, the prompt module 200 may be controlled to send a prompt signal that the refrigerating and freezing device 10 proceeds to the refrigerating operation step. The user is promoted that parasites in the foodstuffs in the storage compartment 110 have been killed and the foodstuffs can be safe to eat. Furthermore, since a frequency of a compressor or the like will change due to returning from the copious cooling operation step to the refrigerating operation step, the operation sound of the refrigerating and freezing device 10 will change. By the prompt signal sent by the prompt module 200, the user knows the operation status of the refrigerating and freezing device 10 and will not doubt the change in the operation sound of the refrigerating and freezing device 10. This improves the intelligence of the refrigerating and freezing device 10.

Figure 6:
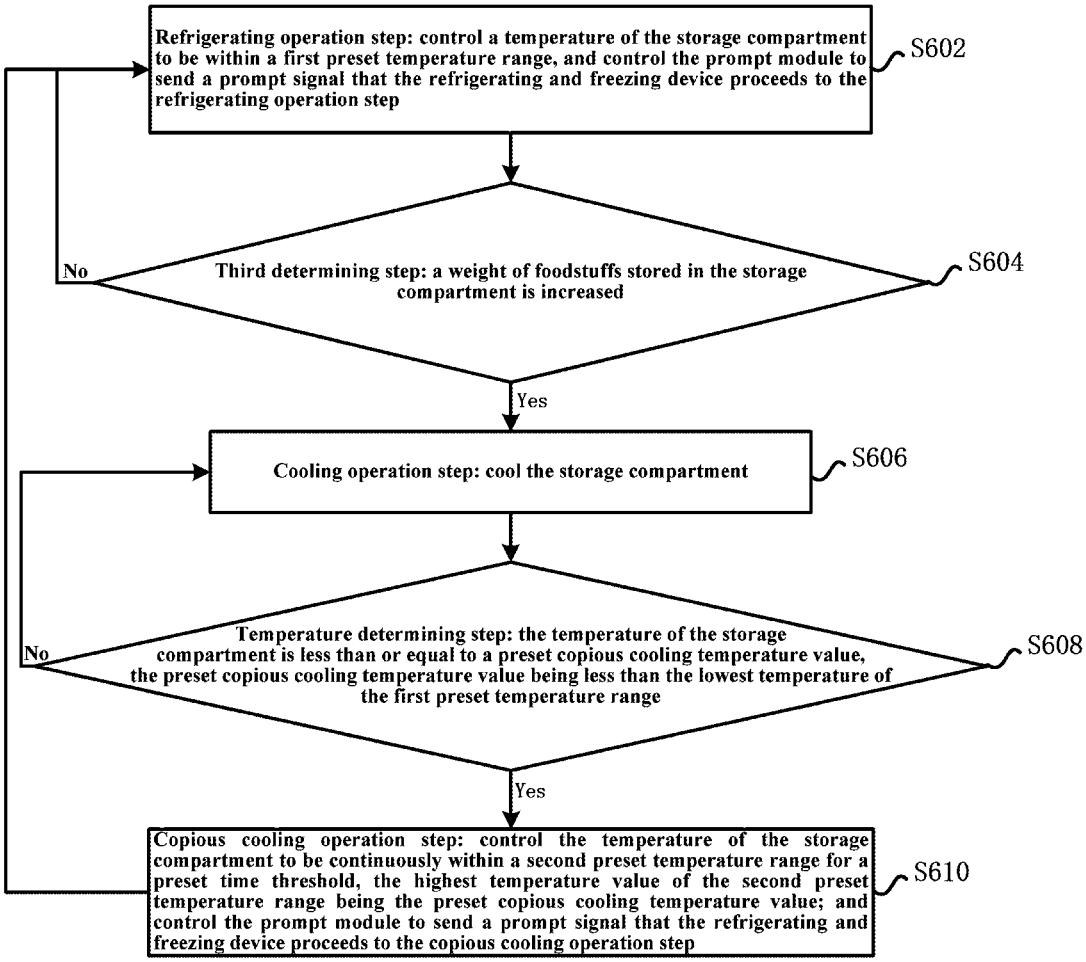
FIG. 6 is an execution flowchart of a control method of a refrigerating and freezing device according to yet another embodiment of the present invention.

FIG. 6 is an execution flowchart of a control method of a refrigerating and freezing device 10 according to yet another embodiment of the present invention. As shown in FIG. 6, an execution flow of the control method of the refrigerating and freezing device 10 according to the embodiment of the present invention may include:

S602, the refrigerating operation step: the temperature of the storage compartment 110 is controlled to be within the first preset temperature range, and the prompt module 200 is controlled to send the prompt signal that the refrigerating and freezing device 10 proceeds to the refrigerating operation step. The first preset temperature range is −17° C. to −19° C. Causing the temperature of the storage compartment 110 to be within the first preset temperature range can not only ensure a preservation effect on foodstuffs, but also avoid the phenomenon of waste of energy.

S604, a third determining step: whether a weight of foodstuffs stored in the storage compartment 110 is increased is determined. This scheme for determining, by means of the weighing module 400 for acquiring the weight of the foodstuffs stored in the storage compartment 110, whether a new foodstuff is put into the storage compartment 110 does not need to be manually operated, so that the refrigerating and freezing device 10 is more intelligent. If not, returning to step S602; and if yes, step S606 is executed.

S606, the cooling operation step: the storage compartment 110 is cooled. Since the temperature of the new foodstuff is greater than that of the original foodstuffs in the refrigerating and freezing device 10, cooling the storage compartment 110 changes a storage temperature suitable for the foodstuffs originally stored in the storage compartment 110 into a storage temperature suitable for the new foodstuff, and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device 10 on the foodstuff is enhanced.

S608, the temperature determining step: whether the temperature of the storage compartment 110 is less than or equal to the preset copious cooling temperature value is determined, the preset copious cooling temperature value being less than the lowest temperature of the first preset temperature range. If not, returning to step S606; and if yes, step S610 is executed.

S610, the copious cooling operation step: the temperature of the storage compartment 110 is controlled to be continuously within the second preset temperature range for the preset time threshold, the highest temperature value of the second preset temperature range being the preset copious cooling temperature value; and the prompt module 200 is controlled to send the prompt signal that the refrigerating and freezing device 10 proceeds to the copious cooling operation step. This control method causes the new foodstuff to enter a status suitable for preservation. The refrigerating and freezing device 10 may have a timing unit. Timing starts when the copious cooling operation step is started, and retiming starts when the temperature of the storage compartment 110 is not within the second preset temperature range. The copious cooling operation step ends till the time counted by the timing unit reaches the time threshold.

In some embodiments, the second preset temperature range may be −20° C. or below. That is, the preset copious cooling temperature value is −20° C. The preset time threshold is 23 h to 25 h. By setting the second preset temperature range, the preset copious cooling temperature value, and the preset time threshold, parasites in the foodstuffs can be killed, so as to further enhance the preservation effect of the refrigerating and freezing device 10 on the foodstuff.

In some embodiments, after the copious cooling operation step, returning to the refrigerating operation step, so as to save energy. In the refrigerating operation step, the prompt module 200 may be controlled to send a prompt signal that the refrigerating and freezing device 10 proceeds to the refrigerating operation step. The user is promoted that parasites in the foodstuffs in the storage compartment 110 have been killed and the foodstuffs can be safe to eat. Furthermore, since a frequency of a compressor or the like will change due to returning from the copious cooling operation step to the refrigerating operation step, the operation sound of the refrigerating and freezing device 10 will change. By the prompt signal sent by the prompt module 200, the user knows the operation status of the refrigerating and freezing device 10 and will not doubt the change in the operation sound of the refrigerating and freezing device 10. This improves the intelligence of the refrigerating and freezing device 10.

This embodiment provides a control method of a refrigerating and freezing device 10 and a refrigerating and freezing device 10. The refrigerating and freezing device 10 includes a cabinet 100 defining a storage compartment 110. The control method includes a refrigerating operation step, a foodstuff determining step, and a cooling operation step. The refrigerating operation step is to control a temperature of the storage compartment 110 to be within a first preset temperature range. The foodstuff determining step is to determine whether a new foodstuff is put into the storage compartment 110. The cooling operation step is to, when a new foodstuff is put into the storage compartment 110, cool the storage compartment 110. Since the temperature of the new foodstuff is greater than that of the original foodstuffs in the refrigerating and freezing device 10, cooling the storage compartment 110 changes a storage temperature suitable for the foodstuffs originally stored in the storage compartment 110 into a storage temperature suitable for the new foodstuff and the storage temperature is more convenient for the preservation of the new foodstuff and ensures good storage conditions for the newly put foodstuff. Furthermore, the preservation effect on the original foodstuffs will not be affected, and the preservation effect of the refrigerating and freezing device 10 on the foodstuff is enhanced.

The second preset temperature range may be −20° C. or below; the preset copious cooling temperature value is −20° C.; and the preset time threshold is 23 h to 25 h. By setting the second preset temperature range, the preset copious cooling temperature value, and the preset time threshold, parasites in the foodstuffs can be killed, so as to further enhance the preservation effect of the refrigerating and freezing device 10 on the foodstuff.

The refrigerating and freezing device 10 further includes a prompt module 200, and the copious cooling operation step further includes: the prompt module 200 is controlled to send a prompt signal that the refrigerating and freezing device 10 proceeds to the copious cooling operation step. The refrigerating operation step further includes: the prompt module 200 is controlled to send a prompt signal that the refrigerating and freezing device 10 proceeds to the refrigerating operation step. This setting mode is convenient for the user to master the operation status of the refrigerating and freezing device 10 at any time, so that the refrigerating and freezing device 10 is more intelligent.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

The invention claimed is:

1. A control method of a refrigerating and freezing device, wherein the refrigerating and freezing device comprises a cabinet defining a storage compartment, and the control method comprises:

a refrigerating operation step: controlling a temperature of the storage compartment to be within a first preset temperature range;

a foodstuff determining step: determining whether a new foodstuff is put into the storage compartment;

a cooling operation step: when a new foodstuff is put into the storage compartment, cooling the storage compartment;

a temperature determining step: determining whether the temperature of the storage compartment is less than or equal to a preset copious cooling temperature value, the preset copious cooling temperature value being less than the lowest temperature of the first preset temperature range; and a copious cooling operation step: when the temperature of the storage compartment is less than or equal to the preset copious cooling temperature value, controlling the temperature of the storage compartment to be continuously within a second preset temperature range for a preset time threshold, the highest temperature value of the second preset temperature range being the preset copious cooling temperature value, wherein the refrigerating and freezing device comprises an input module arranged on the refrigerating and freezing device for acquiring information input by a user, indicating that a new foodstuff is put into the storage compartment, and a weighing module used for acquiring a weight of foodstuffs stored in the storage compartment; and the foodstuff determining step comprises:

a second determining step: determining whether the input module acquires information input by the user indicating that a new foodstuff is put into the storage compartment, and when the input module acquires the information input by the user indicating that a new foodstuff is put into the storage compartment, determining that a new foodstuff is put into the storage compartment; or a third determining step: determining whether the weight of the foodstuffs stored in the storage compartment is increased, and when the weight of the foodstuffs stored in the storage compartment is increased, determining that a new foodstuff is put into the storage compartment.

2. The control method according to claim 1, wherein the refrigerating and freezing device further comprises a prompt module, and the copious cooling operation step further comprises:

controlling the prompt module to send a prompt signal that the refrigerating and freezing device proceeds to the copious cooling operation step.

3. The control method according to claim 2, wherein the control method further comprises:

after the copious cooling operation step, returning to the refrigerating operation step; and the refrigerating operation step further comprises:

controlling the prompt module to send a prompt signal that the refrigerating and freezing device proceeds to the refrigerating operation step.

4. The control method according to claim 1, wherein the second preset temperature range is −20° C. or below; the preset time threshold is 23 h to 25 h.

5. The control method according to claim 1, wherein the first preset temperature range is −17° C. to −19° C.

6. A refrigerating and freezing device, comprising:

a cabinet defining a storage compartment; and a controller, wherein the controller comprises a memory and a processor, the memory storing a control program, and the control program, when executed by the processor, being used for implementing the control method of a refrigerating and freezing device according to claim 1.

* * * * *